United States Patent [19]

Beal et al.

[11] Patent Number: 4,924,937

[45] Date of Patent: May 15, 1990

[54] ENHANCED ELECTROSTATIC COOLING APPARATUS

[75] Inventors: James B. Beal; Michael A. Badinger, both of Slidell, La.

[73] Assignee: Martin Marietta Corporation, Bethesda, Md.

[21] Appl. No.: 307,033

[22] Filed: Feb. 6, 1989

[51] Int. Cl.[5] ..... F28F 13/02; F28F 7/00

[52] U.S. Cl. ..... 165/96; 165/1

[58] Field of Search ..... 165/96

[56] References Cited

U.S. PATENT DOCUMENTS

| | | | |
|---|---|---|---|
| 3,056,587 | 10/1962 | Steigerwald | 165/1 |
| 3,224,497 | 12/1965 | Blomgren, Sr. et al. | 165/2 |
| 3,370,644 | 2/1968 | Daily | 165/1 |
| 3,872,917 | 3/1975 | Blomgren, Sr. et al. | 165/1 |

FOREIGN PATENT DOCUMENTS

| | | | |
|---|---|---|---|
| 53-73655 | 6/1978 | Japan | 165/1 |

*Primary Examiner*—Martin P. Schwadron
*Assistant Examiner*—Allen J. Flanigan
*Attorney, Agent, or Firm*—Seymour Levine; Martin G. Anderson

[57] ABSTRACT

Electrostatic cooling apparatus with a needle emitter insulated along the shank thereof except for a sharp needle tip. The insulated needle emitter is supported along the axis of a funnel tube so as to augment the velocity of the ionic wind generated by the needle emitter. The needle emitter is axially adjusted within the funnel tube to tune the resonant cavity formed by the needle emitter and funnel tube to just below the space charge oscillation frequency.

11 Claims, 2 Drawing Sheets

ENHANCED ELECTROSTATIC COOLING APPARATUS

BACKGROUND OF THE INVENTION

1. Field of the Invention

The invention relates to electrostatic cooling (ESC), particularly with respect to apparatus for enhancing the cooling effects thereof, for example, by providing means for increasing the cooling gas flow. The invention is considered particularly advantageous as applied to welding technology.

2. Description of the Prior Art

ESC has been utilized in the prior art as a heat transfer mechanism to provide cooling. ESC is particularly advantageous in spot cooling such as in welding but has attendant problems.

Prior practice also involved weld solidification in air at room ambient temperature, often with fixed chill bars in positions to provide additional cooling mass. The prior art also utilized fans and air jets to provide spot cooling around the weld puddle. A problem with fans and air jet apparatus is that moving parts are included that require considerable power and tend to be unreliable. The use of chill bars tends to increase the manufacturing cost of the components. Additionally, fans, air jets and chill bars have attendant undesirable space and weight requirements. Utilization and enhancement of heat transfer mechanisms are desirable since unwanted heat effects, occurring during fabrication processes and system operations, adversely affect material properties and electronic component operation. Controlled cooling of weldments can reduce the heat effected zone, diminish residual stress and warping, increase strength and generally improve weld properties.

ESC is a high voltage, low current, non-uniform, high electric field stress, electrostatic gas flow phenomena, associated with needle-like emitters which project a charged jet of ionic wind (negative or positive polarity) to a spot being cooled (opposite polarity). The workpiece being cooled is preferably connected to ground potential. Thus, the needle emitter projects a jet of charged and entrained neutral ambient gas molecules of one polarity to the closest location (spot being cooled) of opposite polarity. ESC apparatus may be considered as an electrostatic jet pump. The pumping action is produced by the high voltage, low current, non-uniform electric field effect radiating from the needle emitter to the grounded conductive surface. This non-uniform force produces motion of air molecules by the combined effects of dielectrophoresis (translational motion of neutral matter caused by polarization effects in a non-uniform electric field), and electrophoresis (the electric field force upon a charged body). ESC is related to the branch of physics known as electrohydrodynamics (EHD), a phenomena applicable to dielectric liquids and gases.

Specifically, intense non-uniform electric fields near the emitter needle attract and ionize some of the neutral air molecules to the same polarity. The ions are repelled from the emitter, collide with other in-transit neutral molecules, and carry them in a jet of charged, ionic wind toward the nearest heated surface of opposite polarity or lower potential. Controlled cooling of welds by ESC may replace chill bars in some applications and can augment the heat transfer rate for metal, non-metals, and composites as compared to other prior art cooling methods.

A further problem encountered in the heat transfer phenomenon is that of the boundary layer immediately adjacent the surface being cooled. Turbulent gas or liquid flows further out are reduced to laminar flows in the boundary layer. The boundary layer tends to insulate the surface thus limiting heat exchange and slowing down convective cooling. It is appreciated that when metal is heated, the tendency for a focussed heat source to form a gradient across the metal provides a mode of cooling known as thermally assisted dielectrophoresis (TAD). Stagnation in convective cooling, however, occurs at the hot solid surface beneath the boundary layer. The laminar flows at the surface that result from the turbulent flows elsewhere limit momentum exchange in the boundary layer. In this heated boundary layer, where the thermal gradient and density are the highest, the polarizability gradient is also the greatest. TAD occurs in this region to provide some cooling effect. TAD is intensified is this region under the influence of a high stress electric field such as provided by ESC. The combination of activity, charged air flow and intensified TAD, tends to cause turbulence and rupture of the surface boundary layer, resulting in enhanced heat transfer from and at the hottest point on the material surface. This may reduce warpage and favorably influence weld metallurgical characteristics. This mode of cooling is inherent in the ESC process of reducing thermal gradients in a metal target. The boundary layer phenomenon is not as effectively obviated utilizing forced gas or other conventional means of cooling such as fans, air jets, or chill bars. Prior art applications of ESC also are not completely effective in reducing the boundary layer phenomenon.

SUMMARY OF THE INVENTION

The present invention comprises ESC apparatus with enhanced gas flow for providing improved heat transfer performance. The emitter needle is coated with an insulating material over substantially its entire length except for the emitter needle tip. The insulated needle is axially disposed in a Venturi tube of dielectric material that increases the velocity of the gas flow around the shielded needle emitter. Preferably, the exposed tip insulated needle and Venturi tube form a tuned resonant cavity emitter. The needle is axially adjusted in the Venturi tube so that the tube, needle, space charge and target to be cooled form a resonant EHD circuit, tuned to just below the space charge (spark gap) oscillation frequency of the resonant circuit. Power is preferably applied to the needle to establish a threshold current and maximum voltage gradient just below the breakdown value of the space impedance such that undesirable Corona discharge does not occur which would tend to be destructive of the ESC effect.

DESCRIPTION OF THE PREFERRED EMBODIMENT

Figure 1:
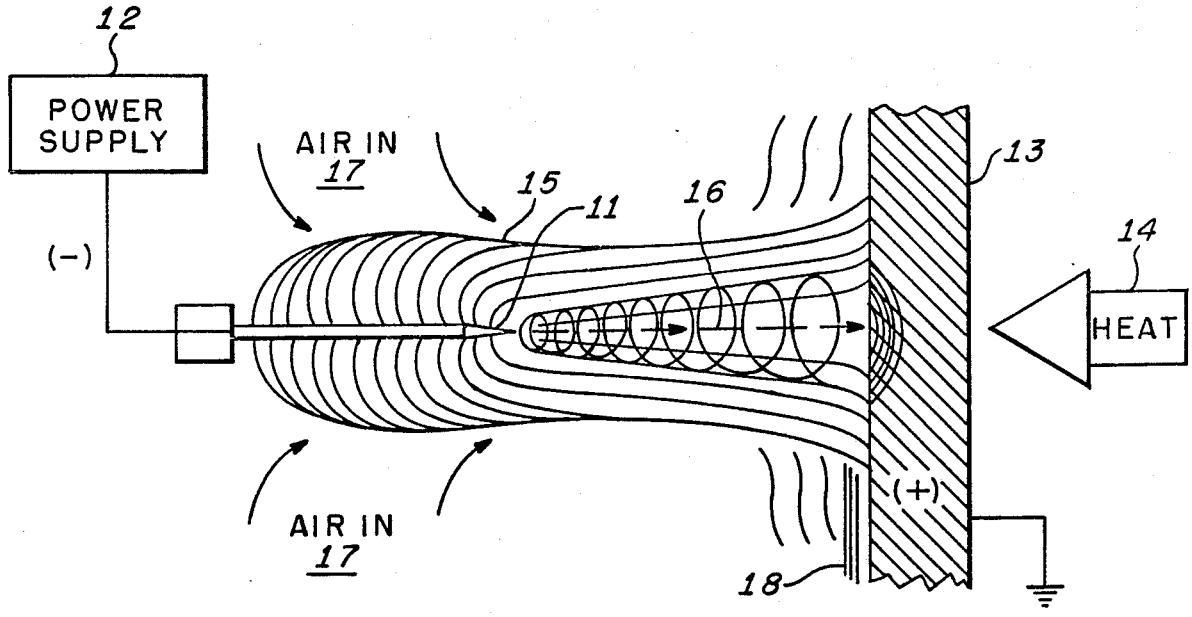
FIG. 1. PRIOR ART
FIG. 1 is a schematic diagram of a prior art ESC arrangement.

Referring to FIG. 1, a prior art ESC arrangement is illustrated. A needle emitter 10 with a tapered tip 11 is connected to a high voltage power supply 12. The power supply 12 provides a high negative potential relative to ground. The needle emitter tip 11 is supported proximate a workpiece 13 to be cooled such as a weldment. The workpiece 13 is grounded and is therefore positive with respect to the emitter needle 10. Heat, such as from a welding torch, is preferably applied in the direction of the arrow 14. An intense electric field 15 is therefore created between the needle 10 and the grounded conductive workpiece 13. An ionic wind 16 is created which impinges on the workpiece 13 to provide spot cooling of the heated area. Ambient gas, such as air, enters the process as indicated by reference numeral 17. A thin boundary layer 18 is formed on the surface to be cooled of the workpiece 13 which impedes heat transfer as discussed above. The electric field 15 emanates and spreads from the entire length of the needle 10 because of random charge exchange therealong. The electric field 15 is only constrained by the geometry of the needle 10 relative to the grounded workpiece 13. Thus, the system has a relatively high entropy resulting in a spreading of the electric field 15 at the spot to be cooled causing a concomitant spreading of the ionic wind impinging on the surface of the workpiece 13. This results in a diminution of the cooling effect of the device.

Figure 2:
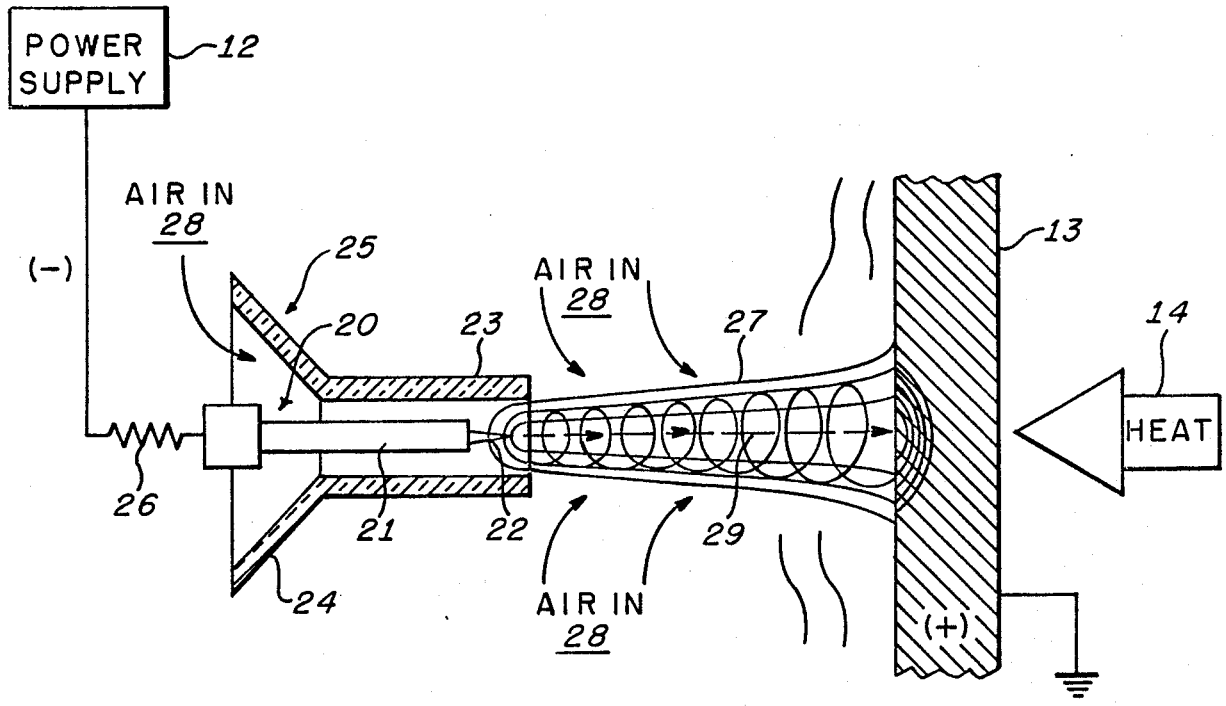
FIG. 2 is a schematic diagram of the ESC arrangement in accordance with the present invention.

Referring to FIG. 2, in which like reference numerals indicate like components with respect to FIG. 1, an ESC arrangement in accordance with the present invention is illustrated. Instead of the simple needle emitter 10 of FIG. 1, a modified shielded emitter 20 is utilized. The needle emitter 20 is insulated along the shank thereof with suitable insulation 21 such as glass, plastic and the like leaving an exposed sharp needle emitter tapered tip 22. The modified needle emitter 20 is mounted along the axis of a gas flow focussing and velocity augmentation tube 23 which extends from a funnel shaped bell 24. Preferably, the tube 23 and the bell 24 comprises a Pyrex glass funnel 25. The needle emitter 20 is coupled to the high potential power supply 12 through a high ohmic current limiting resistor 26. The exposed tapered needle tip 22 creates an intense non-uniform electric field 27 generating enhanced pumping action that results in the cooling ambient gas flow to the hot spot on the workpiece 13. The ambient gas, such as air, enters the process through the bell 24 and also into the electric field 27 as indicated by the reference numeral 28. The Pyrex glass funnel 25 collects the air and focusses the flow for cooling enhancement. The configuration of the invention generates an intense velocity augmented ionic wind 29 that impinges on the hot spot of the workpiece 13. The scrubbing action of the ionic wind ion and electron flow 29 pierces and removes the insulating boundary layer 18 promoting accelerated spot cooling. The enhanced effect of the present invention removes the boundary layer 18 so that no boundary layer is observed to impede the cooling effect.

Figure 3:
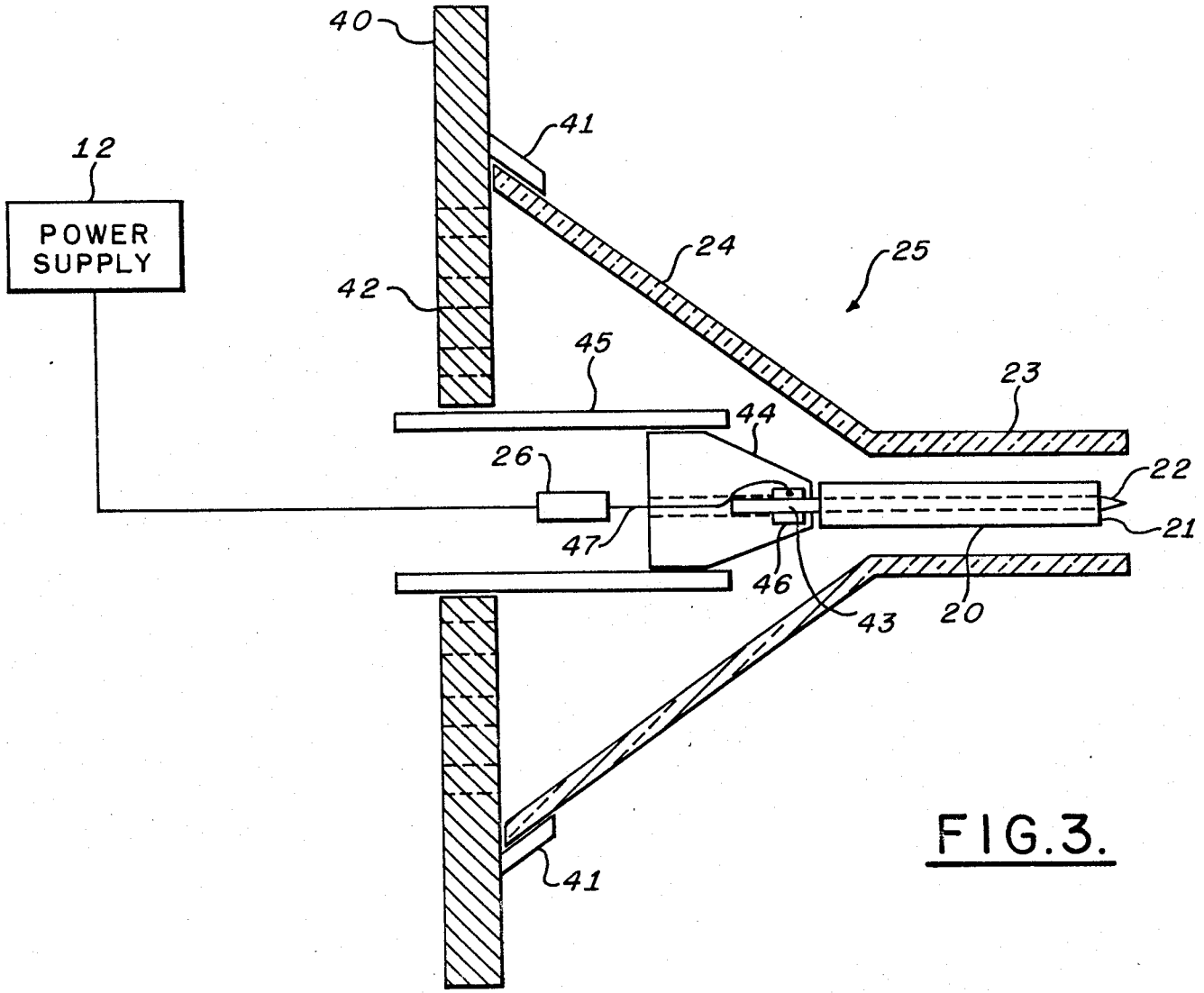
FIG. 3 is a side elevation view, partially in section, showing construction details of a specific embodiment of the ESC arrangement of the present invention.

Referring to FIG. 3, in which like reference numerals indicated like components with respect to FIG. 2, construction details of a specific embodiment of the present invention are illustrated. The bell 24 of the funnel 25 is clamped to a non-metal mounting plate 40 with a suitable clamping device 41. The mounting plate 40 is perforated with through holes 42 to permit unrestricted air flow through the funnel bell 24 and focussing tube 23. Preferably, the mounting plate 40 is constructed of Teflon which has temperature resistant characteristics. The needle 20 is constructed from a refractory metal such as titanium or tungsten to provide extended efficient use and prevent "sputtering" (rapid erosion) of needle material. If tungsten is utilized, the tip 22 has a machined angle of 18° tapering back from a tip hemispherical diameter of 0.009. A titanium needle may be optimized with a tip 22 having a 60° taper. Optimum taper for the needle tip 22 depends on the material utilized. The centered, high voltage, needle emitter pumping element may vary in dimension. For the system described herein, the total needle length is 2.1 inches and its diameter is 0.080 inches. The insulation 21 covers the needle so that only 0.25 inches of the tapered needle tip 22 is exposed. Also a length 43 of needle shank of approximately 0.5 inches is left exposed at the end of the needle. The 1.35 inch length of insulation 21 may be glass, heat shrink plastic tubing or a similar insulative material. The tapered needle tip 22 is exposed to create the intense, non-uniform electric field pumping action required for the cooling air flow. The focussing tube 23 has an inside diameter of 0.47 inches and a length of 1.0 inches. The funnel bell 24 has an inside diameter of 2.5 inches. The over-all length of the device is approximately 3 inches. A tapered Teflon needle holder 44 is press fit into a 0.357 inch inside diameter Pyrex glass tube 45 which extends through the Teflon mounting plate 40. The glass tube 45 with holder 44 and needle emitter assembly 20 is a slip-fit through the Teflon mounting plate 40 which allows axial adjustment within the tube 23 of the emitter 20 for tuning the system thereby optimizing the corona wind, in a manner to be described. The funnel bell 24 is clamped to the Teflon mounting plate 40 so that the funnel tube 23 encircles the needle assembly 20 which is centered within and parallel to the funnel tube 23.

A metal sleeve 46, for effecting electrical connection to the exposed end 43 of the needle emitter 20, is centrally recessed within the tapered Teflon holder 44. A high voltage wire 47 is soldered to the sleeve 46. The high voltage wire 47 connects to the power supply 12 through the resistor 26 within the glass tube 45. In the described embodiment, the power supply 12 provides 20–37 kilovolts. Preferably, the resistor 26 has a resistance value of 40 Mohms.

The uninsulated portion 43 of the shank of the needle assembly 20 is inserted into the holder 44 and hence into the metal sleeve 46 for effecting electrical connection to the high voltage supply 12. The assembly 20 is inserted into the holder 44 until the insulation 21 covering the shank is flush with the end of the holder 44. Corona dope is then brushed over the Teflon holder 44 and the area where the shank of the emitter needle 20 enters the center of the holder 44. The corona dope seals and insulates the areas where the emitter needle shank end 43 is disposed within and contacting the metal sleeve 46 within the holder 44, preventing local air ionization and spark breakdown in that area.

Preferably, the distance from the end of the emitter system tube 23 to the target surface being cooled is 0.6 inches. The power for the emitter 20 is provided by the power supply 12 through a high voltage cable to the connector sleeve 46. The power passes through the resistor 26 to reduce current surges should arcing occur. The sharp tip of the needle emitter 20 is adjusted to tune the system within a range of several tenths of an inch. Generally the end of the needle coincides with the end of the tube 23.

The system is tuned as follows. A spark (visible arcing or a spot of light at the emitter tip 22) must be prevented since a spark destroys the pumping action of the system. The system is adjusted just below the spark threshold and it is desirable to establish and hold a threshold current and maximum voltage gradient up to, but not to exceed, the breakdown value of the space impedence. The insulated needle assembly 20 and the Pyrex tube 23 form a resonant cavity emitter. This spark gap oscillation electromagnetic resonance phenomenon is optimized by the axial adjustment of the needle tip 22 with respect to the end of the funnel tube 23. When the end of the funnel tube 23 and point of the needle emitter tip 22 are aligned in a darkened room, a point of light ("firefly") is observed on the needle point. As the emitter needle point is moved back within the funnel tube 23, the light gradually dims and is extinguished. This is the adjustment for proper spark gap oscillation, maximum pumping, minimum entropy, and minimum destructive corona. Additionally, the resistor 26 provides a passive current-limiting device providing suppression of destructive corona which may precipitate arcing and loss of pumping action.

The spark gap or space charge oscillation occurs in the gap between the emitter tip 22 and the target. The oscillation ranges in frequency from 20–50 KHz depending on the gap. It is believed that this phenomenon may enhance subsurface heat transfer effects and material properties. It is believed that subsurface eddy currents may be induced by the oscillation frequency varying potentials to provide these effects and cooling efficiency enhancement of the system. It is appreciated that maximum gas flow velocity occurs at a point just before arcing occurs from the emitter tip 22 to the surface being cooled. Once arcing is initiated, the jet velocity decreases and cooling action is destroyed.

Means (not shown) are included to provide continuous manual or automatic monitoring during operation of the system to maintain voltage and current values just below the arcing point. A rapid, real-time adaptive control of these factors is utilized. The control permit the high voltage potential to approach the arcing point and as arcing is just about to occur, the potential difference between the emitter and target is decreased, creating a pulsing alternating current action. On sensing the approach of the arcing condition, the voltage is reduced and swings the other way (reduction is potential) to follow the changing electrical factors in the gap which are endeavoring to compensate for the rapid rise. Control of the EHD circuit characteristics and the alternating current oscillations in the gap between the emitter and target surface improve the pumping action.

The tuned system of the present invention focusses the jet of charged gas on the surface to be cooled. The invention utilizes the natural frequencies generated within the intense non-uniform space charge in the gap between the end of the tube 23 and the target surface to create the resonant condition and extreme turbulence in the boundary layer of the target. With the prior art arrangement of FIG. 1, a thin boundary layer is present. Utilizing the enhancements of the present invention results in no observable boundary layer. Thus, it is appreciated that the violent, turbulent scrubbing action provided by the present invention completely removes the stagnant boundary layer of heated air from the surface of the heated target.

The ESC ionic wind jet velocity is increased by the present invention since the funnel outlet tube 23 constrains the incoming ambient gas (such as air) to the vicinity of the shank of the needle emitter 20 where the gas is drawn toward the high voltage tip 22 with its intense non-uniform field. The insulation characteristics of the glass tube 23 also constrains the intense field locally so that the concentration thereof around the needle tip 22 is enhanced for directing the ionic wind jet at the surface to be cooled. Gas flow is thus concentrated and directed outward from the end of the tube 23, providing a system with a more efficient pumping action (minimum entropy) than in prior art systems exemplified by FIG. 1.

The insulation 21 on the modified needle assembly 20 contributes to the improvement in the velocity of the ESC ionic wind jet since the needle shank is insulated to within approximately 0.25 inches of the tip 22. The intense non-uniform field gradient (of negative polarity with respect to the tip, in the case of air) is maintained by reducing the charge exchange along the shank of the needle emitter 20. This reduces the entropy caused by random charge exchange. Ions are then attracted toward the target (ground return) of opposite polarity and repelled from the tip 22 at a higher velocity than in the previous systems such as those exemplified by FIG. 1. The ions radiate from the angular surface of the needle tip 22 and are constrained and directed by the Pyrex glass outlet tube 23 of the funnel 25. Penetration of the boundary layer, by ionized gas particles seeking an electrical ground at the area of least resistance, promotes the cooling action. It is appreciated that the charged jet is attracted to the hottest area since that area has the highest electrical conductivity. The charged jet is also attracted by the TAD phenomenon described above. Thus, it is appreciated that the present invention provides the highest possible field gradient between the emitter tip 22 and the target up to the point of space charge breakdown. Insulation of the needle emitter shank increases the electric flux density at the exposed tip 22 due to the reduced charge exchange along the insulated shank.

The present invention has the advantages of being inherently mechanically and electrically simple, portable, low cost, low power and small size. The invention is furthermore advantageous in having no moving parts and utilizing solid state components of high reliability. The invention provides precise electronic control of air flow and direction.

By utilization of the present invention, an ionic wind velocity increase of approximately 101% is achieved and a heat flux increase of approximately 51% is effected compared to the prior art ESC arrangements such as that exemplified in FIG. 1. Compared to ambient air cooling, the present invention provides a heat flux increase of approximately 500%. When utilized for spot cooling of weldments, the present invention provides higher tensile strength, higher elongation and less warpage than prior art cooling methods. Additionally, increased hardness, more refined grain structure, improved metallurgical properties and reduced residual weld stresses are achieved with the present invention.

The present invention has application in weldment solidification, high speed machining operations (especially refractory material), accelerated curing of composites, cooling of spacecraft components (during launch, mission, and re-entry), plasma arc hard coating deposition, heat pipes, brazing, and heat exchanging in gas-filled environments for increasing heat transfer from operating components to space. It is appreciated that since ESC is limited in operation to environments at more than 3 PSIA or less than 38,000 feet altitude, a sealed-in recirculating gas system would be required for avionics or structures in the space environment. It is noted that certain gases such as sulfur hexafluoride and helium have three and four times, respectively, the cooling efficiency of air when used with ESC.

The present invention may be utilized to increase flow for:

(1) increasing heat transfer from a hotter conductive material surface into a surrounding cooler environment, i.e., thin weldments or special heat exchangers (aircraft, spacecraft, missiles, sealed systems).

(2) increasing heat transfer from a hotter gas into a cooler conductive surface material, i.e., into a radiator exposed to the outer space environment, and (3) propulsion, i.e., ion pumping of air at normal or reduced air pressure to generate, enhance and/or control thrust for aircraft. It should be noted that this design may also enhance ion propulsion and control for spacecraft, when a suitable material (gas, liquid or particulate matter) is supplied as an atmosphere to be pumped.

It is appreciated that the structure disclosed and described with respect to FIGS. 2 and 3, is fabricated primarily from temperature resistant Teflon plastic and Pyrex glass. The emitter needle 20 must be at least one inch distant from any grounded metal structure, other than the surface to be cooled, to prevent undesirable arcing.

While the invention has been described in its preferred embodiment, it is to be understood that the words which have been used are words of description rather than limitation and that changes may be made within the purview of the appended claims without departing from the true scope and spirit of the invention in its broader aspects.

We claim:

1. Electrostatic cooling (ESC) apparatus including a metallic needle emitter adapted to be connected to a source of high electrical potential, said needle emitter having an emitter tip, said needle emitter providing an ESC ionic wind for cooling a target, comprising:

a tube of dielectric material, and a coating of dielectric material coating said needle emitter, except for said emitter tip, thereby providing an insulated needle emitter, said insulated needle emitter being deposed within said tube so as to enhance the velocity of said ionic wind.

2. The apparatus of claim 1 wherein said tube of dielectric material has a central axis and said insulated needle emitter is disposed along said axis.

3. The apparatus of claim 2 wherein said insulated needle emitter, said tube and said target comprise a tuned resonant cavity having a space charge oscillation frequency, said apparatus further including:

means for adjusting said insulated needle emitter along said axis to tune said cavity, said adjustment being effected so as to tune said cavity just below said space charge oscillation frequency.

4. The apparatus of claim 3 further including a funnel bell connected to said tube so that said funnel bell and said tube form a funnel.

5. The apparatus of claim 4 wherein said funnel is comprised of temperature resistant glass.

6. The apparatus of claim 5 wherein said temperature resistant glass comprises Pyrex glass.

7. The apparatus of claim 1 wherein said coating of dielectric material comprises temperature resistant glass.

8. The apparatus of claim 7 wherein said temperature resistant glass comprises Pyrex glass.

9. the apparatus of claim 1 wherein said coating of dielectric material comprises heat shrink plastic.

10. the apparatus of claim 3 wherein said insulated needle emitter is axially adjusted with respect to said tube so that a spot of light on said emitter tip just disappears.

11. The apparatus of claim 10 further including means for adjusting a source of high electrical potential coupled to said needle emitter.

* * * * *